US007579945B1

(12) United States Patent
Richter et al.

(10) Patent No.: US 7,579,945 B1
(45) Date of Patent: Aug. 25, 2009

(54) SYSTEM AND METHOD FOR DYNAMICALLY AND EFFICENTLY DIRECTING EVACUATION OF A BUILDING DURING AN EMERGENCY CONDITION

(75) Inventors: Christian Richter, Dublin (IE); Antonio Sanso, Dublin (IE); David Rockett, Dublin (IE); Harshita Nersu, Navan (IE)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/142,968

(22) Filed: Jun. 20, 2008

(51) Int. Cl.
*G08B 29/00* (2006.01)

(52) U.S. Cl. ..... 340/506; 340/522; 340/524; 340/286.14

(58) Field of Classification Search ..... 340/691.6, 340/506, 517, 522, 524, 539.22, 539.26, 340/577, 628, 632, 286.14
See application file for complete search history.

(56) References Cited

U.S. PATENT DOCUMENTS

| | | | | |
|---|---|---|---|---|
| 4,074,225 | A | 2/1978 | Vandeweghe | |
| 6,873,256 | B2 * | 3/2005 | Lemelson et al. | 340/539.1 |
| 7,259,656 | B1 | 8/2007 | Wright | |
| 7,277,018 | B2 * | 10/2007 | Reyes et al. | 340/573.1 |
| 2003/0234725 | A1 * | 12/2003 | Lemelson et al. | 340/521 |
| 2004/0201470 | A1 * | 10/2004 | Reed | 340/506 |
| 2005/0151640 | A1 * | 7/2005 | Hastings | 340/539.11 |
| 2006/0118636 | A1 | 6/2006 | Miles et al. | |
| 2006/0215023 | A1 | 9/2006 | Coonce et al. | |
| 2007/0008408 | A1 | 1/2007 | Zehavi | |
| 2007/0024708 | A1 | 2/2007 | Lin et al. | |
| 2007/0279210 | A1 | 12/2007 | Li et al. | |
| 2008/0048851 | A1 * | 2/2008 | Reyes et al. | 340/506 |

FOREIGN PATENT DOCUMENTS

| | | | |
|---|---|---|---|
| WO | WO 93/20544 | | 10/1993 |
| WO | WO 2004/097567 | A2 | 11/2004 |
| WO | WO 2007/030141 | A2 | 3/2007 |
| WO | WO 2007/044380 | A2 | 4/2007 |

* cited by examiner

*Primary Examiner*—Benjamin C. Lee
*Assistant Examiner*—Travis R Hunnings
(74) *Attorney, Agent, or Firm*—Locke Lord Bissell & Liddell LLP

(57) ABSTRACT

An emergency response system capable of directing building occupants to a safe location in real-time is disclosed. The system comprises a plurality of sensors which detect and monitor an emergency condition, a central processing unit which evaluates the data, calculates accessible evacuation routes, and sends the result to output devices which provide directional information to occupants. By combining an analysis of the flow of evacuees with changes in building structural information and the evolution of an emergency condition the system combines situation-aware data with contextual information to thereby provide the best available evacuation route to evacuees. In this manner, some evacuees may be redirected to alternate evacuation routes during the evacuation process itself, thereby minimizing problems due to congestion, potential panic of the evacuees, and changes in the emergency condition while increasing the probability that evacuees will reach a safe location.

1 Claim, 2 Drawing Sheets

SYSTEM AND METHOD FOR DYNAMICALLY AND EFFICENTLY DIRECTING EVACUATION OF A BUILDING DURING AN EMERGENCY CONDITION

BACKGROUND

1. Field of the Disclosure

This disclosure relates generally to an emergency response system. In particular, the present disclosure relates to a method of directing evacuation of a building by combining situation-aware data with knowledge about the context of an emergency condition.

2. Description of the Related Art

Any type of building or structural enclosure capable of holding a number of people at any given time is generally required to have at least one evacuation route available to occupants. Such an evacuation route is a necessary safety precaution due to the remote, but ever-present threat of danger. The danger itself may appear as, for example, a fire, gas leak, or structural collapse. Environmental factors such as a hurricane, tornado, or earthquake may also create an emergency condition. Whatever the cause, in each instance it is necessary for the building to have a means of directing occupants to either exit the building via the appropriate evacuation route or take cover in a safe location.

The resources needed to guide occupants to safety are roughly proportional to the size, complexity, and occupational capacity of the building. Thus, it is especially crucial for sprawling, multi-room, multi-level, and/or high-rise buildings to be equipped with a suitable emergency response system. The system itself may be comprised of appropriately placed sensors or triggering devices which, when activated, may generate an audible alarm along with visual cues such as a flashing strobe light indicating that an emergency condition exists within the building. Depending upon the nature of the emergency, occupants may be directed to leave the building through the nearest marked exit. The evacuation route itself may be identified via auditory information such as instructions provided over a broadcast system and/or visual identifiers such as an exit sign or directional arrows.

Under normal conditions most evacuees will choose to exit via the closest and most familiar evacuation route. However, it is possible that an evacuation route may be unknown or inaccessible to an occupant. It is also possible that the route may become blocked or unsafe due to propagation of an emergency condition. Furthermore, during the evacuation process itself a large group of people may congregate in a certain direction or on a particular exit. This, in itself, can become hazardous, particularly if people are in a panicked state. Thus, the evacuation process is dynamic in the sense that the optimal route may constantly change depending upon the flow of people, evolution of the emergency condition, location of emergency personnel, and structural changes occurring within the building. However, during these situations building occupants do not have the situational awareness, contextual knowledge, or time to properly assess all available options to determine the optimal evacuation route.

It is therefore an object of this disclosure to provide an emergency response system which is capable of combining situation-awareness with contextual information to continuously and instantaneously provide evacuees with real-time directional information to guide them to a safe location.

Another object of the disclosure is to provide a method of evacuating a building during an emergency condition by following the directional output provided by the emergency response system.

SUMMARY

In view of the above-described problem, it is an object of the present disclosure to provide a method of directing evacuation of a building during an emergency condition. The method provides a dynamic system which continuously adjusts the supplied optimal evacuation routes in real-time based on the evolution of the emergency condition, flow of evacuees, location of emergency personnel, and changes in the structural integrity of the building. The advantages inherent to such a system provide for a quicker, safer, and more efficient response to emergency conditions.

In one embodiment these advantages are realized by placement of a plurality of sensors including at least automatic and manual door status, image, heat, and smoke sensors. The sensors provide measurement and location data which identify the status and location of the sensors. The information provided by the sensors is received by a central processing unit (CPU) which generates a building floor plan based on the sensor measurement and location data. Data on the flammability and structural integrity of the building as well as locations of emergency personnel is received by the CPU and superimposed onto the building floor plan in order to formulate a plurality of potential safe evacuation routes.

When an emergency condition is detected by a sensor, its location and the type of emergency condition present are identified by the CPU. Based upon the building plan, building material flammability information, status of available exits, locations of emergency personnel, and the location and type of emergency condition, an accessible evacuation route is calculated. Building occupants are then alerted and directed to the accessible evacuation route using the appropriate output devices to provide directional indication.

During the evacuation process itself, occupant movements, building structural integrity, locations of emergency personnel, status of exits as open or closed, as well as the location and type of emergency condition are actively monitored and a plurality of alternative accessible evacuation routes are calculated based on the monitoring result. Alternative accessible evacuation routes are continuously updated and provided to building occupants in response to changes in the monitoring result. Output devices are used to provide directional indication and thereby redirect occupants to the alternate accessible evacuation routes. In the event a non-evacuable section containing occupants is identified, a signal is sent to emergency personnel disclosing the location of the non-evacuable section.

DETAILED DESCRIPTION

Figure 1A:
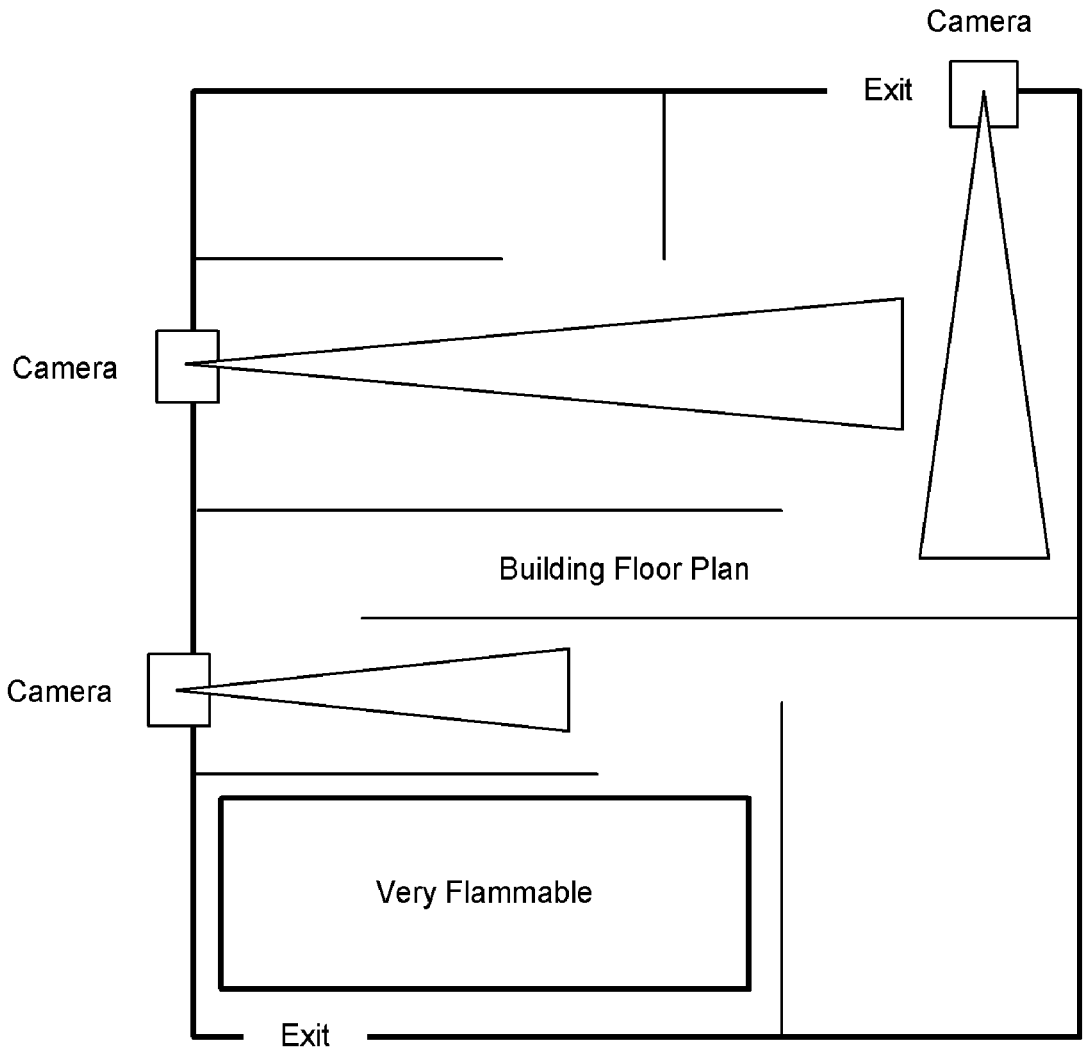
FIG. 1A shows a floor plan having cameras that feed information regarding the building floor plan to the central processing unit. Structural information such as material flammability or building statics is superimposed on the building floor plan.
Figure 1B:
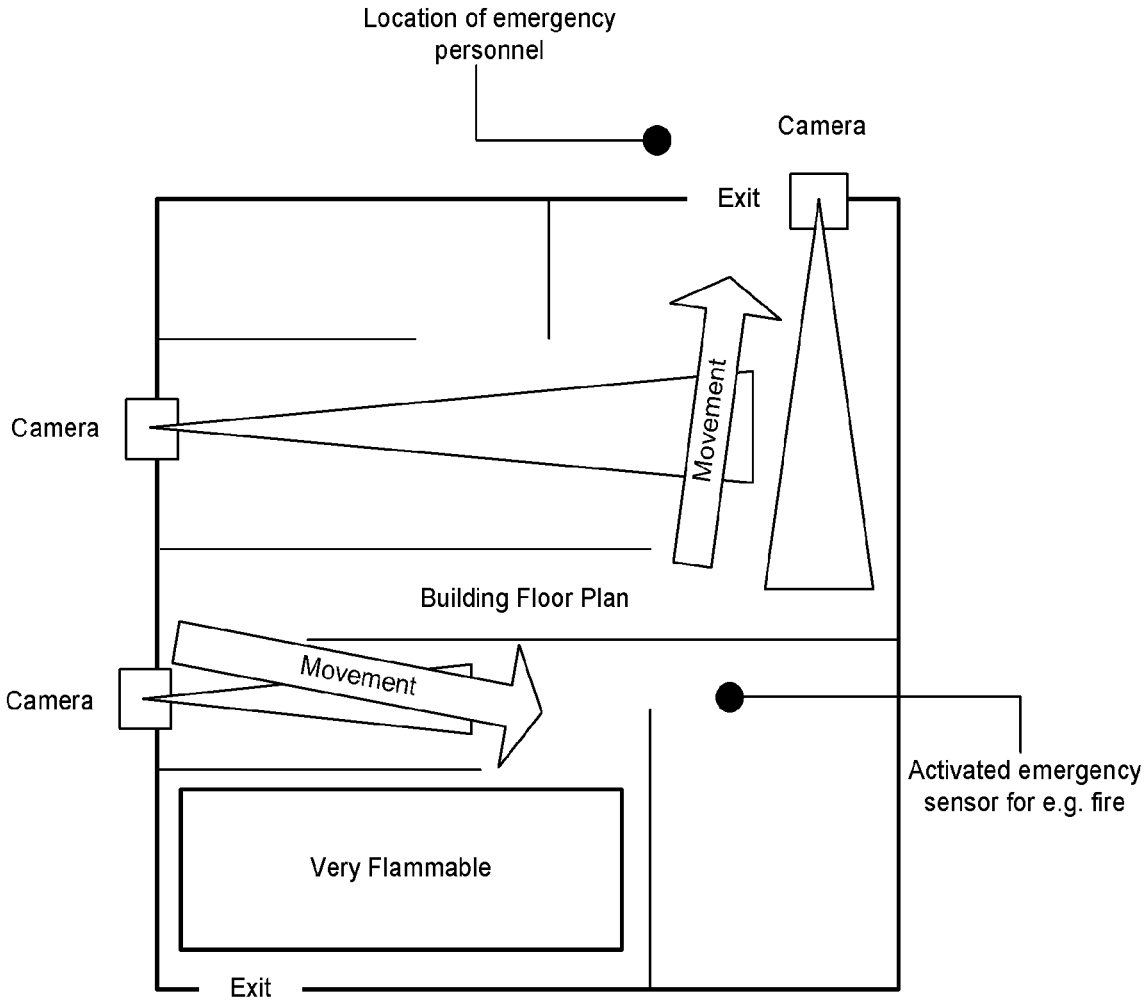
FIG. 1B shows possible evacuation routes calculated by the central processing unit in response to an emergency condition.

The above and other objectives of the disclosure will become clearer from the following description and exemplary embodiments which, when taken in conjunction with FIGS. 1A-B, explain the disclosure in greater detail.

The disclosure is directed to an emergency response system which calculates a plurality of evacuation routes in real-time using situation-aware data in conjunction with information about the context of the situation. Situational awareness involves the use of decentralized data (i.e., video feed from different cameras, voice recognition from microphones) to determine, for example, the flow of evacuees toward a certain exit and then redirect a plurality of them to alternative exits based upon a real-time analysis of the video feed. Such an analysis may be done automatically using the appropriate software capable of recognizing and analyzing video and audio content. By redirecting some of the evacuees along alternate evacuation routes problems due to congestion and potential panic of the evacuees themselves can be minimized.

When directing evacuees, the emergency response system acquires contextual information such as the nature and location of the emergency condition, the structural integrity, flammability, and reactivity of materials in the building, a determination of whether exits along a particular route are open or closed, and the location of emergency personnel or rescue units. By analyzing the available information, risk factors may be calculated and evaluated in order to determine the optimal evacuation routes. These risk factors may be based on, for example, the proximity of an evacuation route to the location of the emergency and the type of emergency in conjunction with building information. The emergency response system combines the situation-aware data with the contextual information and, based on predetermined risk thresholds, calculates optimal evacuation routes and then delivers this result to evacuees by means of suitably placed output devices. Operation of the emergency response system is explained in further detail by means of the following illustrative example.

A building emergency response system is comprised of a plurality of sensors complemented by cameras which provide a live video stream to the CPU. The cameras are suitably positioned such that a plurality of pathways leading to each emergency exit are within the visible range of the cameras.

The CPU further comprises a suitable intelligent video processing system capable of providing, for example, traffic, occupancy, and other information derived from video images of sections of the building. The intelligent video processing system analyzes views from the various cameras and outputs relevant data and composite information in real time. The CPU is also configured to send and receive information from local emergency response teams such as rescue crews, ambulances, or fire departments. This information may comprise, for example, an estimated arrival time as well as projected and/or current locations of emergency personnel.

A typical configuration is provided in FIG. 1A which is a schematic illustrating a building floor plan with two exits and three cameras. Each detector is configured with location information that identifies to the CPU the location of the sensor with respect to a top-down view of the building floor plan. Location information for each camera further comprises the orientation of the camera with respect to the building floor plan and the viewing area covered. The CPU uses the location of the detectors and cameras along with the orientation of the video stream to put the information into context.

Information obtained from the juxtaposition of sensors is then combined with information related to the building itself. This information may be in the form of the flammability of building materials, structural integrity or statics of the building, and presence of fire-secure doors. Such information is overlaid on the existing building plan by the CPU as shown in FIG. 1A. Here, building material in close proximity to the exit at the lower left corner is identified as very flammable.

When an emergency condition such as a fire actually occurs a sensor in the vicinity of the fire will detect the fire and send a response to the CPU. Alternatively, an occupant may be alerted to the presence of the fire and manually activate a nearby alarm. Since the position of the sensor in the building is known, the location of the fire can be determined by the CPU. FIG. 1B shows an example of a sensor which has been activated by a fire. Once the sensor has been activated the CPU alerts building occupants to the presence of the fire by sending the appropriate signal to a plurality of output devices. As previously noted, the alert itself may be provided by means of a type of audio or visual alarm which may be coded with the nature of the emergency. For example, a fire may be noted by a specific sound or flashing red light whereas the presence of toxic gases may be distinguished by a different sound and a flashing yellow light.

Once the occupants have been alerted to the presence of an emergency condition and the need to evacuate, the CPU then calculates a plurality of evacuation routes which circumvent the location of the fire and direct evacuees to the nearest exit. Such a route may be calculated, for example, by simple path-finding algorithms. If a calculated path passes too close to an activated sensor or an area that indicates the potential for danger (e.g., the area containing flammable material in FIG. 1B) then an alternative path is calculated. Thus, in FIG. 1B the CPU will recognize that the route to the exit in the lower left corner involves passing too close to the source of the fire and through an area containing flammable materials. In this case an evacuation route which proceeds away from the danger zone and towards the exit at the top right will be favored.

When determining the appropriate evacuation route, the CPU factors in information such as the status of exits along the evacuation route as well as the location of emergency personnel. Each exit may be equipped with both manual and automatic door sensors which identify to the CPU whether the exit is open or closed. Under normal operating conditions the CPU will obtain door status information from the automatic door sensors. However, in some instances an automatic door sensor may fail and an exit that is actually closed may be incorrectly identified to the CPU as being open. In this case, when a building exit is identified as closed or inaccessible by an occupant of the building, a manual door sensor may be manually activated. The manual door sensor then overrides the automatic door sensor and indicates to the CPU that the door is closed and therefore inaccessible to evacuees.

Information may also be exchanged with emergency response and rescue units such that the status and location of emergency personnel is identified to the CPU. The CPU is also capable of sending information relating to the nature and status of the emergency condition to the emergency response teams. When the location of emergency personnel is known, the CPU uses this information when evaluating potential evacuation routes. Thus, if one path would lead building occupants to exit the building at a location which is in closer proximity to the location of emergency personnel, this path will be given a higher priority. The priority given may also include factors such as the type of emergency response unit and nature of the emergency. For example, if a fire breaks out then occupants may preferentially be directed to the location of a firefighting unit, but if a chemical spill or gas leak occurs then occupants may be preferentially directed to an ambulatory unit.

The emergency response system may also be configured to respond to audial cues such as a scream from a person who may be injured or is in danger by providing the appropriate directions to and from the person. In configuring the emergency response system it will be necessary for the user to assign a danger level or range to the various inputs analyzed by the CPU in order for the system to assess the various risk levels and determine the best course of action based on a comparative analysis of the danger involved.

The CPU processes all available information and calculates a plurality of safe and accessible evacuation routes. The CPU then provides the appropriate directional information to evacuees by sending a signal to corresponding output devices. These output devices may include, but are not limited to a speaker, television monitor, lighted arrows, a lighted sign, a projector, flat panel, liquid crystal or other type of display.

Directional indication may appear from these output devices in the form of a text message, a directional arrow indicating a path to follow, or an auditory message providing evacuation instructions. Such directional information may be provided by a single output device or any combination of output devices. Since the location of the output devices is known to the CPU, the appropriate directional signal can be supplied to each output device based on the results of the evacuation route calculations.

Once evacuation commences the CPU continuously monitors the response in real time by analyzing the status of the emergency condition and flow of evacuees along the calculated evacuation routes. If the number of evacuees proceeding along a given route exceeds a predetermined threshold then the CPU adjusts the output sent to the directional indicators to redirect some evacuees along alternative evacuation routes. The CPU then monitors the diverging flow of evacuees and continually redirects traffic to alternate routes as needed to minimize congestion and ensure the safety of the evacuees.

When recalculating the optimal evacuation route the status of the emergency condition is continually monitored and factored into the calculations. Thus, if the fire spreads and activates another sensor, activation of a manual door sensor indicates that an exit is blocked, the location of emergency personnel changes, or a portion of the building collapses due to a loss of structural integrity, these are detected by the CPU and used to calculate a new evacuation route. Another example which may be factored into the calculations is fire containment. If the presence of a fire in one portion of the building is known, the system can provide directional information such that passageways leading to the location of the fire are not opened. In this manner it is possible to promote containment of the fire itself since, if these passageways were opened additional oxygen would be supplied, thereby causing a dangerous flare-up.

The emergency response system is also capable of identifying sections within the building where a safe evacuation route is not available to occupants (e.g., the occupants are trapped) As an example, if all evacuation routes from a particular area within the building are blocked or identified as closed by the CPU and the presence of occupants in that area is detected by video cameras, the CPU will then send a signal to local emergency response units. The signal may include information such as the location where occupants are trapped, the number of occupants, and the status of the emergency condition. Based upon the information provided, emergency personnel can devise a strategy for safely rescuing the trapped occupants.

The above example is merely exemplary of one potential emergency situation. The system can be configured to respond to a plurality of emergency conditions which include, but are not limited to those noted above (i.e., an earthquake, tornado, toxic gas leak, etc.). No matter the nature of the emergency, once the CPU receives a signal from any of the plurality of sensors, it alerts building occupants, calculates a plurality of safe evacuation routes based on the type and location of the emergency and then sends directional information to the appropriate output devices. Furthermore, as noted above, the emergency response system is dynamic in the sense that it continually monitors the status of the emergency condition and the response of evacuees. Based on the monitoring result the optimal evacuation path is recalculated and directional information is continually updated.

It will be appreciated by persons skilled in the art that the present disclosure is not limited to what has been particularly shown and described hereinabove. Rather, the scope of the present disclosure is defined by the claims which follow. It should further be understood that the above description is only representative of illustrative examples of embodiments. For the reader's convenience, the above description has focused on a representative sample of possible embodiments, a sample that teaches the principles of the present disclosure. Other embodiments may result from a different combination of portions of different embodiments.

The description has not attempted to exhaustively enumerate all possible variations. The alternate embodiments may not have been presented for a specific portion of the disclosure, and may result from a different combination of described portions, or that other undescribed alternate embodiments may be available for a portion, is not to be considered a disclaimer of those alternate embodiments. It will be appreciated that many of those undescribed embodiments are within the literal scope of the following claims, and others are equivalent.

What is claimed is:

1. A method of directing evacuation of a building during an emergency condition comprising:

receiving sensor signals from a plurality of sensors including at least automatic and manual door status, image, heat and smoke sensors, wherein the sensor signals comprise sensor measurement data and location data identifying a location of the sensor in the building;

generating a building floor plan based on the sensor measurement and location data;

receiving building material flammability and structural integrity information;

superimposing the building material flammability and structural integrity information with the building floor plan;

detecting an emergency condition in a sensor;

identifying a location of the emergency condition in the building based on the location of the sensor detecting the emergency condition;

identifying a type of emergency condition based on the sensor measurement data;

monitoring the automatic and manual door status sensors to determine whether exits are open or closed;

identifying locations of emergency personnel;

calculating an accessible evacuation route based on a building plan, building material flammability information, location of emergency personnel, status of each door as opened or closed, and the location and type of emergency condition;

directing occupants to the accessible evacuation route using output devices to give directional indication to occupants;

actively monitoring occupant movements, the structural integrity of the building and the location and type of emergency condition, a location of emergency personnel, and an availability of evacuation routes;

recalculating a plurality of alternative accessible evacuation routes based on the monitoring result; and continuously providing an alternative accessible evacuation route to the occupants in response to changes in the monitoring result and redirecting occupants to the alternate accessible evacuation route using output devices to give direction indication to occupants and, when a non-evacuable section containing occupants is located, sending a signal to emergency personnel identifying a location of the non-evacuable section.

* * * * *